United States Patent [19]

Speich

[11] Patent Number: 4,895,006

[45] Date of Patent: Jan. 23, 1990

[54] CROCHETING MACHINE

[75] Inventor: Francisco Speich, Gipf-Oberfrick, Switzerland

[73] Assignee: Textilma AG, Hergiswil, Switzerland

[21] Appl. No.: 225,524

[22] Filed: Jul. 28, 1988

[30] Foreign Application Priority Data

Jul. 30, 1987 [CH] Switzerland ..... 02921/87

[51] Int. Cl.[4] ..... D04B 23/00

[52] U.S. Cl. ..... 66/203; 66/208

[58] Field of Search ..... 66/203, 208, 120

[56] References Cited

U.S. PATENT DOCUMENTS 3,079,778 3/1963 Kubelka ..... 66/85 A 4,266,410 5/1981 Schneider ..... 66/120

4,503,688 3/1985 Vogel et al. ..... 66/85 A

FOREIGN PATENT DOCUMENTS 495036 11/1938 United Kingdom ..... 66/208

*Primary Examiner*—Ronald Feldbaum

*Attorney, Agent, or Firm*—Toren, McGeady & Associates

[57] ABSTRACT

A crocheting machine has slide needles (2) with knitting needles (4) which are disposed on a knitting needle bar (6). Slides (8) of the slide needles (2) are attached at a slide bar (10) which is disposed over the knitting needle bar (6). Thus, a simple and rugged construction for the crocheting machine is obtained.

9 Claims, 3 Drawing Sheets

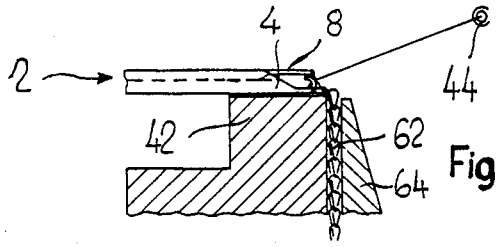
Fig. 5
Fig. 6
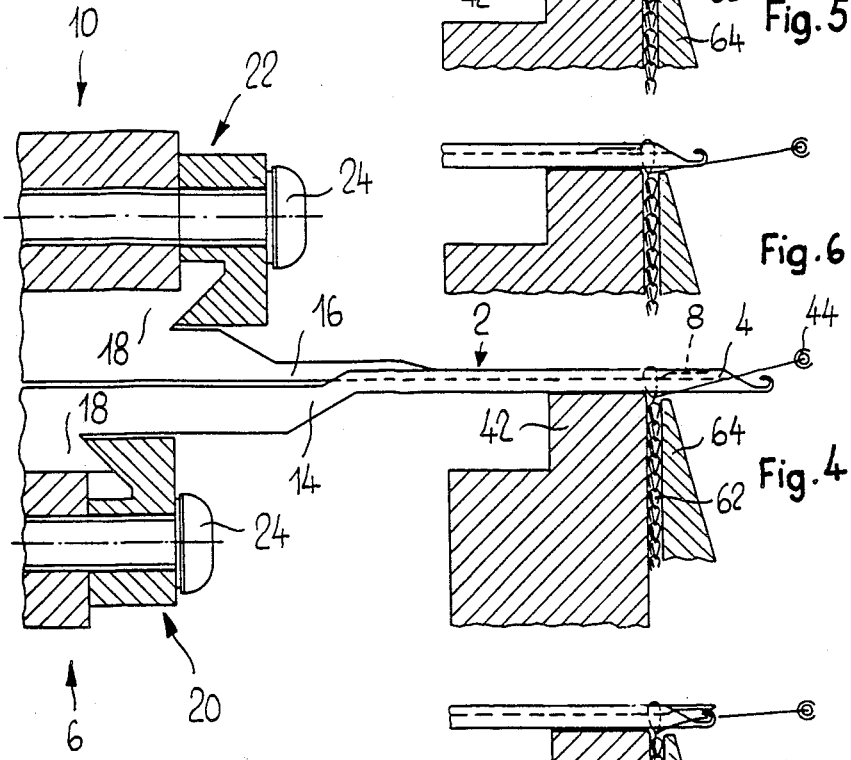
Fig. 4
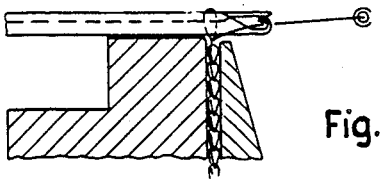
Fig. 7
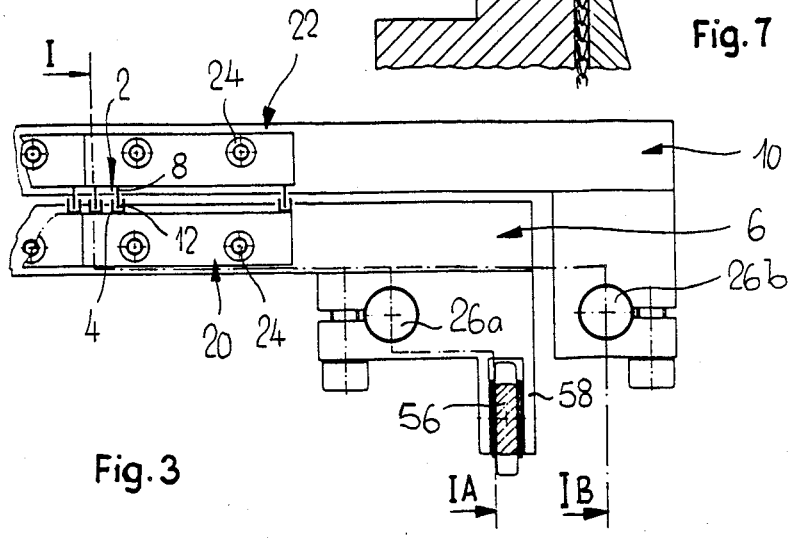
Fig. 3

CROCHETING MACHINE

FIELD AND BACKGROUND OF THE INVENTION

The present invention relates in general to crochet-knitting machines and, in particular, to a new and useful crocheting machine having slide needles disposed on a slide needle bar with knitting needles that are disposed on a knitting needle bar. The knitting needle bar and the slide bar are disposed one above the other.

It is known to equip warp knitting machines which do not provide any filling yarn guide that cooperate with knitting needles with slide needles, as taught, for example, by German Patent No. 17 60 140 (U.S. Pat. No. 3,724,241 to Zwingenberger et al.). In this reference, the knitting needle bar and the slide bare are disposed side-by-side and at the oscillating lever, respectively. The oscillating levers have to provide a relatively big radius so that the path of motion of the knitting needles is not too curved. Therefore, the arrangement and the guiding of the knitting needles and the slide require a relatively big volume in the overall construction. For this reason, slide needles which still provide a filling yarn guide could not be used for crocheting machines, e.g., crochet galloon machines, which in German are called "Häkelgalon-maschinen".

SUMMARY OF THE INVENTION

It is an object of the present invention to improve crochet-knitting machines.

A further object of the present invention is to provide a crocheting machine comprising a knock-over rail, a plurality of slide needles provided for crosswise to-and-fro movement with respect to the knock-over rail, and at least one filling yarn guide mounted for movement crosswise to the slide needles, each of the slide needles comprising a knitting needle and a slide engaged with each knitting needle, a knitting needle bar connected to all of the knitting needles and a slide bar connected to all of the slides, the knitting needle bar and slide bar being disposed one above the other.

Since the knitting needle bar and the slide bar are disposed one above the other, a relatively simple and rugged construction is obtained.

It is particularly advantageous if the slide bar is disposed over the knitting needle bar. An especially rugged construction is obtained when the knitting needles and slides are disposed, respectively, at the sides of the knitting needle bar and slide bar which face each other, or on the sides of the bars which are turned away from each other. Attachment of the knitting needles and slides can be achieved using clamps and screws or the like, which are on a side of the bars facing away from the ends of the knitting needles which produce the knitted product. This improves access to the structures for holding the knitting needles and slides to their respective bars. It is especially advantageous to provide the knitting needles and slides with dovetailed projections which are held by clamping devices to the respective bars.

The knitting needle bar and slide bar are advantageously mounted for linear to-and-fro movement that is parallel to each other. This is advantageously achieved by providing a gear casing having linearly movable pusher shafts that are connected to the respective knitting needle and slide bars.

In accordance with the present invention, a simple drive mechanism is provided by connecting drive rollers to each of the pusher shafts and rotatably mounting cams in the drive casing which engage the drive rollers to move the pusher shafts to and fro with rotation of the cam.

It is especially advantageous in accordance with the invention to provide warp thread guides which are assigned to the slide needles and are in driving connection with the knitting needle bar for movement of the warp thread guides with movement of the knitting needle bar. To this end, the warp thread guide for each knitting needle is attached to a carrier which is connected to a toggle lever over a linking member. The toggle lever is mounted for rotation on a shaft and is connected through a linking rod to the knitting needle bar.

The knitting needles can be guided in a known manner in guide grooves of the knock-over rail. It is possible, according to the present invention, however, to provide a knock-over rail having a straight surface on which the knitting needles lie without any lateral guidance for the knitting needles.

Another feature of the invention is to provide the filling yarn guides in the form of tube yarn guides.

A still further object of the present invention is to provide a crocheting machine and, in particular, a crochet gallooning machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

BRIEF DESCRIPTION OF THE DRAWINGS

In the drawings:

FIG. 3 is an elevational view of the crochet galloon machine taken on line III—III of FIG. 1; and FIGS. 4 through 7 are side views, partly in section, of areas of the slide needles of the crochet galloon machine of FIG. 1 on a larger scale and in different working positions.

DESCRIPTION OF THE PREFERRED EMBODIMENT

Figure 1:
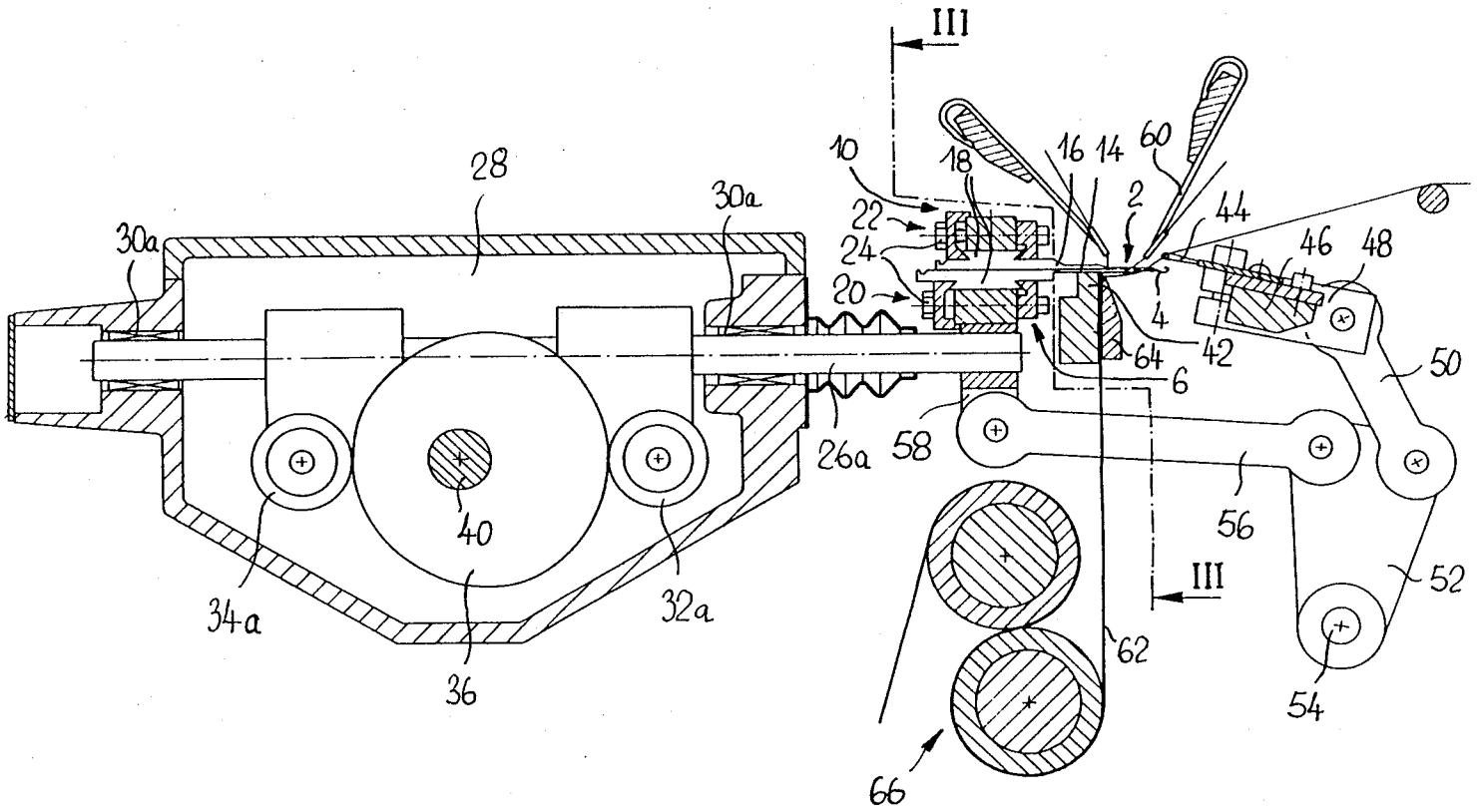
FIG. 1 is a sectional view of a crochet galloon machine of the invention taken on line I–IA of FIG. 3.
Figure 2:
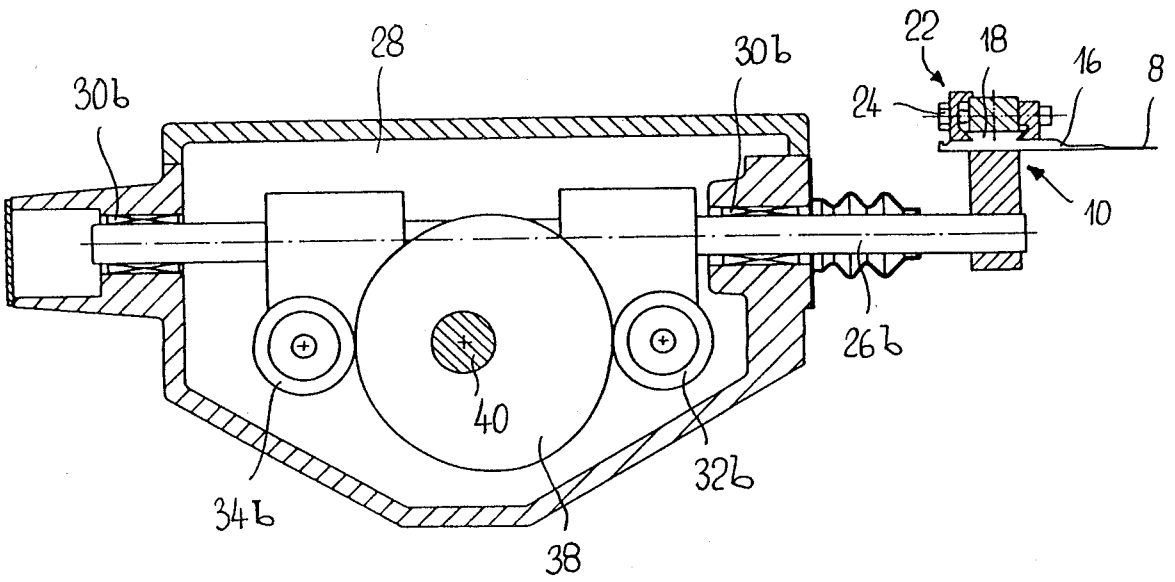
FIG. 2 is a view similar to FIG. 1, showing the drive of the slide of the crochet galloon machine and taken on line I-IB of FIG. 3.

FIGS. 1 through 7 show the pertinent parts of the inventive crocheting galloon or crochet machine for the production of a machine knitted product (in German "Kettengewirk") which, in itself, is known.

This crochet galloon machine has slide needles 2, knitting needles 4 disposed on a lower knitting needle bar 6 and sides 8 disposed on a slide bar 10 which lies above the lower knitting needle bar 6. The slides 8 are guided in guide grooves 12 of the knitting needles 4 as shown in FIG. 3. In order to attach the knitting needles 4 and the slides 8, they have, at their rearward shafts 14 and 16, dovetailed projections 18, by which they are clamped tightly in a clamping device 20 and 22 of the knitting needle bar 6 and the slide bar 10, respectively.

Tightening screws 24 serve to screw down the clamping devices 20, 22. These tightening screws 24 are accessible from the rear or from below for the knitting needle bar 6 and the slide bar 10. The knitting needle bar 6 and the slide bar 10 are attached to pusher shafts 26 and 26*b*, respectively, which serve to support and drive the bars to and fro. The shafts 26*a*, 26*b* are guided displaceably in a gear casing 28 on two sleeve bearings 30*a*, 30*b*. Two drive rollers 32*a*, 34*a*, and 32*b*, 34*b* mounted on each pusher shaft 26*a* and 26*b*. These cooperate with corresponding cams 36 and 38 which are mounted on a drive shaft 40 in the gear casing 28. Rotation of shaft 40 causes cams 36, 38 to rotate. This drives rollers 32*a*, 34*a* and 32*b*, 34*b* back and forth which, in turn, moves shafts 26*a*, 26*b* to and fro on their bearings 30*a* and 30*b*. Thus, such pusher shafts 26 are provided for the knitting needle bar 6 as well as for the slide bar 10. The corresponding cams at the driving shaft 40 are fashioned according to the need of motion of the knitting needles 4 and the slide 8. This, however, is not represented in the drawings.

The knitting needles 4 of the slide needles 2 are slidable on a knock-over rail 42 which is fashioned in a straight line, meaning that no guide grooves are provided for laterally guiding the knitting needles 4. A set of warp thread guides 44 is assigned to the slide needles 2, the warp thread guides 44 being attached to a pivotable carrier 46. An arm 48 is connected to the carrier 46 which, in turn, is connected to a toggle lever 52 via a linking member 50.

The toggle lever 52, which is pivotally supported on an axis 54, is in driving connection with a projection 58 of the knitting needle bar 6 via a linking member 56. Thus, the warp thread guides 44 are moved up and down in a vertical direction, synchronously with the to-and-fro movement of the knitting needle bar 6.

Above the knock-over rail 42, several different filling thread guides 60 are disposed in a known manner. Guides 60 are fashioned, for example, as tube thread guides. The produced knitting machine 62 is drawn off downwardly in a slot which is formed between the knock-over rail 42 and a ribbed guide 64 by means of a draw-off device 66.

While a specific embodiment of the invention has been shown and described in detail to illustrate the application of the inventive principles, it will be understood that the invention may be embodied otherwise without departing from such principles.

What is claimed is:

1. A crocheting machine, comprising a knock-over rail, a plurality of slide needles mounted for crosswise to-and-fro motion with respect to the knock-over rail, a warp thread guide for each slide needle and at least one tube filling yarn guide mounted for movement across said slide needles for cooperating with said slide needles to produce knitting, said slide needles each comprising a knitting needle and a slide slidably engaged with said knitting needle, a knitting needle bar connected to the knitting needle of all of said slide needles and a slide bar connected to the slide of all of said slide needles, said slide bar being mounted above the knitting needle bar, said knitting needle and slide bars having sides which face each other and said knitting needles and slides being mountable to said respective knitting needle and slide bars on said sides which face each other, said knitting needle and slide bars being mounted for movement parallel to each other and each having a side extending substantially parallel to the direction of movement for said knitting needle and slide bars, said knitting needles and slide bars being connected to said sides of said knitting needles and slide bars, respectively, each of said knitting needles and slides including a dovetailed projection, and clamping means for clamping said dovetailed projections of said knitting needles and slides to said knitting needle and slide bars, respectively.

2. A crocheting machine according to claim 1, wherein said sides of said knitting needle and slide bars to which said knitting needles and slides are detachably connected so as to face away from said at least one tube filling yarn guide.

3. A crocheting machine according to claim 1, including drive means connected to said knitting needle bar and to said slide bar for moving said knitting needle and slide bars in straight to-and-fro movement.

4. A crocheting machine according to claim 3, wherein said drive means comprises a gear casing, a pusher shaft for each of said knitting needle and slide bars, each pusher shaft being mounted for linear movement to said gear casing.

5. A crocheting machine according to claim 4, wherein said drive means further comprises at least one drive roller mounted to each of said pusher shafts and a cam rotatably mounted to said gear casing and engaged with each of said drive rollers for moving said pusher shafts in linear to-and-fro movement.

6. A crocheting machine according to claim 1, including warp thread guides interacting with slide needles and connecting means for drivingly connecting each warp thread guide to said knitting needle bar.

7. A crocheting machine according to claim 6, wherein said connecting means comprises a carrier for carrying said warp thread guide for all of said slide needles, an arm connected to said carrier, a toggle lever mounted for movement adjacent said arm, a linking member connected between said toggle lever and said arm and a linking rod connected between said toggle lever and said knitting needle bar for transmitting movement of said knitting needle bar through said toggle lever to said carrier.

8. A crocheting machine according to claim 1, wherein said knock-over rail has a straight grooveless surface on which said knitting needles move to and fro without lateral guidance.

9. A crocheting machine according to claim 1, wherein said knitting needle and slide bars include facing surfaces, drive means for linearly moving said knitting needle and slide bars parallel to each other and to said facing surfaces, said knitting needles and slides being connected to said facing surfaces of said knitting needle and slide bars, respectively, said drive means comprising a gear casing, a shaft rotatably mounted in said gear casing, a cam connected to said shaft for each of said knitting needle and slide bars, a pusher shaft mounted for linear movement to said gear casing for each of said knitting needle and slid bars, and at least one drive roller connected to each of said pusher shafts and engaged with one of said cams for to-and-fro movement of each of said pusher shafts with rotation of said cam shaft.

* * * * *